US006084355A

United States Patent [19]

Park

[11] Patent Number: 6,084,355

[45] Date of Patent: Jul. 4, 2000

[54] CIRCUIT FOR CONTROLLING POWER SUPPLIED TO A CATHODE HEATER OF A CATHODE RAY TUBE

[75] Inventor: Tae Jin Park, Suwon, Rep. of Korea

[73] Assignee: SamSung Electronics Co., Ltd., Kyungki-do

[21] Appl. No.: 08/990,905

[22] Filed: Dec. 15, 1997

[30] Foreign Application Priority Data

Dec. 14, 1996 [KR] Rep. of Korea ..... 96-65937

[51] Int. Cl.[7] ..... H05B 37/02

[52] U.S. Cl. ..... 315/106; 315/107; 327/550

[58] Field of Search ..... 315/94, 106, 107; 327/550

[56] References Cited

U.S. PATENT DOCUMENTS

| | | | |
|---|---|---|---|
| 3,731,142 | 5/1973 | Spira et al. . | |
| 3,767,967 | 10/1973 | Luz . | |
| 3,881,126 | 4/1975 | Boots et al. . | |
| 3,883,767 | 5/1975 | Buescher et al. . | |
| 3,886,401 | 5/1975 | Berg . | |
| 3,947,715 | 3/1976 | Puhak . | |
| 3,982,153 | 9/1976 | Burdick et al. . | |
| 4,379,980 | 4/1983 | Takanashi et al. . | |
| 4,388,551 | 6/1983 | Ray . | |
| 4,661,745 | 4/1987 | Citino et al. . | |
| 4,675,573 | 6/1987 | Miram et al. . | |
| 4,857,808 | 8/1989 | Lally et al. . | |
| 5,010,274 | 4/1991 | Phillips et al. . | |
| 5,319,281 | 6/1994 | Roth . | |
| 5,424,620 | 6/1995 | Cheon et al. . | |
| 5,440,205 | 8/1995 | Tahara et al. . | |
| 5,493,336 | 2/1996 | Racek et al. | 315/94 |
| 5,583,395 | 12/1996 | Lu . | |

*Primary Examiner*—Michaal B. Shingleton
*Attorney, Agent, or Firm*—Robert E. Bushnell, Esq.

[57] ABSTRACT

A cathode heater of a cathode ray tube is rapidly energized either when turning on electric power or when returning to a power-on state mode of the Display Power Management System (DPMS) in an electronic appliance using the cathode ray tube as a video display device. A high voltage generation unit is provided for generating a voltage higher than a rated voltage of the cathode heater of the cathode ray tube. The cathode ray tube enables a stable video display to be presented in a shorter time period due to a rapid heating of the cathode caused when an initial heating unit applies a voltage to the cathode heater which is higher than the rated voltage of the cathode heater, according to a pulse signal which exists for a predetermined time period when turning on electric power or when returning to a power-on state mode of the DPMS. A voltage drop unit is provided to drop the voltage of the high voltage generation unit to the rated voltage of the cathode heater when the predetermined time period elapses so that the cathode heater is thereafter energized with the rated voltage for that cathode heater, in order to maintain the cathode at a normal operating temperature.

19 Claims, 2 Drawing Sheets

CIRCUIT FOR CONTROLLING POWER SUPPLIED TO A CATHODE HEATER OF A CATHODE RAY TUBE

CLAIM OF PRIORITY

This application makes reference to, incorporates the same herein, and claims all benefits accruing under 35 U.S.C. §119 from an application for HEATER-HEATING CIRCUIT FOR A CATHODE RAY TUBE AND METHOD THEREFOR earlier filed in the Korean Industrial Property Office on the Dec. 14, 1996, and there duly assigned Ser. No. 65937/1996, a copy of which is annexed hereto.

BACKGROUND OF THE INVENTION

1. Technical Field

The present invention relates to a cathode ray tube, and more particularly to a circuit for controlling a cathode heater of a cathode ray tube by rapidly warming the cathode heater when an electronic appliance using a cathode ray tube is turned on or when such an appliance returns to a power-on mode from an operation mode which has cut off the electric power supply to a Display Power Management System (DPMS) cathode heater.

2. Related Art

A cathode ray tube is widely used as a video display device in electronic appliances such as monitors and television sets. An electric power supply energizes the cathode heater of an electron gun provided in the neck portion of the cathode ray tube. The energized cathode heater causes the cathode to be heated and to generate thermoelectrons. The thermoelectrons generated from the cathode are controlled, converged and accelerated by a plurality of grids provided in the electron gun that they strike the fluorescent surface in front of the electron gun, and thereby display an image.

Before the cathode is heated up to a normal operating temperature, thermoelectron emission is unstable and the cathode ray tube cannot present a stable image. Conversely, after the cathode is heated up to a normal operating temperature, the cathode ray tube can present a stable image since thermoelectron emission becomes stable.

A slow cathode warm-up time has been considered undesirable by the public because this causes a delay between the moment the cathode ray tube is turned on and the moment an acceptable picture appears on the face of the cathode ray tube. Several techniques have been attempted to decrease the time required to heat a cathode in a cathode ray tube, and to thereby decrease the time required to wait for an acceptable picture.

The Display Power Management System (DPMS) was proposed by the Video Electronic Standard Association (VESA) of the United States of America. DPMS is an electric power supply management system for reducing electric power consumption of a video display system such as a monitor, which is a computer peripheral, in accordance with a use state of a computer system.

According to DPMS, electric power management is performed in four modes by selectively outputting and cutting off a horizontal synchronization signal and a vertical synchronization signal in the main body of the computer system according to a use state, and by corresponding with the horizontal synchronization signal and vertical synchronization signal from the main body of the computer system in the video display device. The four modes are classified as a power-on state mode, a stand-by state mode, a suspension state mode and a power-off state mode.

The video display device is operated in the power-on state mode when both the horizontal and vertical synchronization signals are input from the main body of the computer system. The video display device is operated in the stand-by state mode when only the vertical synchronization signal is input. The video display device is operated in the suspension state mode when only the horizontal synchronization signal is input. The video display device is operated in the power-off state mode when neither the horizontal nor the vertical synchronization signals are input. In the power-off state mode, electric power consumption must be less that 5 W.

One technique used to cause the cathode to reach an operating temperature quickly requires that the cathode be kept warm all the time, by means of a bleeder current. This technique has been called an "instant-on" feature and has been provided on some televisions by television receiver manufacturers. With this feature, a viewable picture is obtained on the cathode ray tube almost instantaneously with the turn-on of the television. The bleeder current used to accomplish this feature constantly maintains the cathode heater at a near-normal operating temperature. Thus, in effect, the cathode ray tube is never completely turned off. One example of this "instant-on" feature is disclosed in U.S. Pat. No. 3,767,967 for Instant-On Circuitry for AC/DC Television Receivers issued to Luz. This feature might be considered to be wasteful of electrical energy since the television is constantly drawing electrical power. Also, this feature could present a fire hazard.

Another technique used to cause the cathode to reach an operating temperature quickly requires a modification in the design of the cathode heater. Some examples of this are disclosed in U.S. Pat. No. 3,881,126 for Fast Warm-Up Cathode Assembly issued to Boots et al., U.S. Pat. No. 5,424,620 for Display Apparatus for Displaying Pictures Virtually Instantaneously issued to Cheon et al., U.S. Pat. No. 3,883,767 for Heater for Fast Warmup Cathode issued to Buescher et al. and U.S. Pat. No. 4,379,980 for Quick Operating Cathode issued to Takanashi et al. Also, the cathode design may be modified in order to enable the cathode to reach an operating temperature quickly. Some cathode design modifications are disclosed in U.S. Pat. No. 3,947,715 for Fast Warm Up Cathode for a Cathode Ray Tube issued to Puhak, U.S. Pat. No. 4,675,573 for Method and Apparatus for Quickly Heating a Vacuum Tube Cathode issued to Miram et al. and U.S. Pat. No. 4,388,551 for Quick-Heating Cathode Structure issued to Ray.

Another technique used to cause the cathode to reach an operating temperature quickly is to use a fast-acting heater circuit. This type of circuit is typically designed to energize the cathode heater in such a way as to cause the cathode heater to become warm quickly. The object of this type of circuit is to cause the cathode heater to become warm as quickly as possible, thereby decreasing the overall time required to cause the cathode to reach a normal operating temperature.

One example of a fast-acting heater circuit is disclosed in U.S. Pat. No. 3,886,401 for Apparatus for Accelerating Cathode Heating issued to Berg. This circuit includes at least two positive temperature coefficient (PTC) resistors. Upon activation of this circuit, the room-ambient resistance of the element allows passage of a surge of current which then decreases to the normal cathode heater operating level as the temperature of the resistive element increases. Because PTC resistors cause heat-related energy consumption, this circuit might be considered to be a poor utilizer of electrical energy. Also, this circuit might be considered to lack precision, due to the PTC resistors.

A second example of a fast-acting heater circuit is disclosed in U.S. Pat. No. 3,982,153 for Rapid Warm-Up Heater Circuit issued to Burdick et al. This circuit utilizes a degaussing circuit, a temperature responsive resistive element (such as a PTC resistor) and at least two transformers. Some might have the opinion that this circuit lacks precision and that this circuit poorly utilizes electrical energy, due to the use of the temperature responsive resistive element. Others might believe that this circuit is undesirable due to the high cost associated with the use of two transformers. Still others may dislike the inherent limitation presented by the fact that a degaussing circuit is required.

Cathode and cathode heaters are used in fluorescent light tubes. Some of the developments in the rapid warn-up of fluorescent light tubes are disclosed in U.S. Pat. No. 4,857,808 for Modified Impedance Rapid Start Fluorescent Lamp System issued to Lally et al., U.S. Pat. No. 5,5,010,274 for Starter Circuits for Discharge Lamps issued to Phillips et al., U.S. Pat. No. 5,583,395 for Fluorescent Device Having a Fluorescent Starter Which Precisely Controls Heating Time and Absolute Synchronisn of Fire Point issued to Lu, U.S. Pat. No. 5,440,205 for Fluorescent Lamp Starter Having a Transistor Base Control Means issued to Tahara et al., U.S. Pat. No. 5,319,281 for Fluorescent Tube Heating and Starting Circuit issued to Roth, U.S. Pat. No. 4,661,745 for Rapid-Start Fluorescent Lamp Power Reducer issued to Citino et al. and U.S. Pat. No. 3,731,142 for High-Frequency Fluorescent Tube Lighting Circuit with Isolating Transformer issued to Spira et al.

SUMMARY OF THE INVENTION

Accordingly, it is therefore an object of the present invention to provide an improved circuit for controlling a cathode heater of a cathode ray tube.

It is another object to provide a circuit which rapidly energizes the cathode heater at the initiation of operating mode, thereby raising the temperature of the cathode quickly, with the result being that a viewable video display is provided in a short time period.

It is yet another object to provide a circuit for controlling a cathode heater which operates in a cost effective, reliable, and precise manner.

It is still another object to provide a circuit which has no power drain when the cathode ray tube is not in an operating mode, and therefore conserves electrical energy and eliminates any fire hazard from continuously partially energized circuitry.

These and other objects of the present invention can be achieved by an apparatus that consists of a high voltage generation unit, an instant heating signal generation unit, an initial heating unit, and a voltage drop unit. The high voltage generation unit is used to generate a high voltage to be applied to a cathode heater of a cathode ray tube. The aforementioned high voltage is higher than the cathode heater's rated voltage. The instant heating signal generation unit is used to generate a driving pulse signal during a predetermined time period in order to facilitate the application of a high voltage to the cathode heater to warm up the cathode either when turning on electric power or when changing to a DPMS power-on state mode. The high voltage generated from the high voltage generation unit is applied through an initial heating unit to the cathode heater so that the cathode can be rapidly heated during the driving pulse signal. A rated voltage generated by dropping the high voltage of the high voltage generation unit through a voltage drop unit is applied to the cathode heater when the driving pulse signal is cut off after the predetermined time period elapses. The rated voltage is applied to the cathode heater when the driving pulse signal is cut off.

Therefore, according to the present invention, a cathode is rapidly heated at the initiation of operation mode because a high voltage is applied to the cathode heater, said high voltage being higher that the rated voltage for the cathode heater. Thereafter, when the cathode is heated to a normal operating temperature, the rated voltage is applied to the cathode heater. In other words, according to the present invention, a cathode is rapidly heated by applying a high voltage exceeding the rated voltage when the cathode heater is first energized, upon the initiation of operating mode. Later, when the cathode reaches its normal operating temperature, the voltage applied to the cathode heater drops down to the rated voltage.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
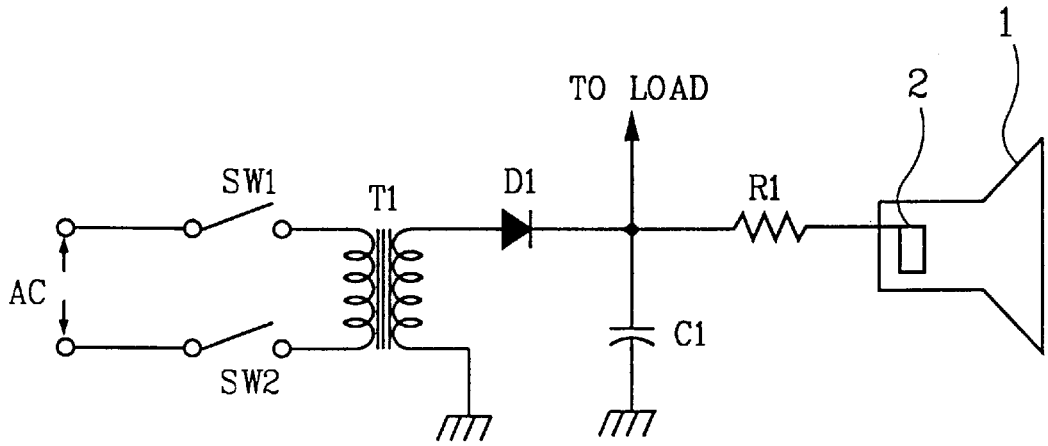
FIG. 1 illustrates a circuit for controlling a cathode heater of a cathode ray tube.

Referring now to the drawings and particularly to FIG. 1, which illustrates a circuit for controlling a cathode heater of a cathode ray tube. A reference numeral AC denotes an AC voltage of an AC electric power source. The voltage AC is supplied to a primary winding of a power transformer T1 through power switches SW1 and SW2. A secondary winding of the power transformer T1 is connected to a ground capacitor C1 through a diode D1, and the juncture of the diode D1 and the ground capacitor C1 is connected to a cathode heater 2 of a cathode ray tube 1 in through a resistor R1.

In the circuit in FIG. 1, the voltage AC is applied to the primary winding of the power transformer T1 through the power switches SW1 and SW2 to induce an AC voltage across the secondary winding when the power switches SW1 and SW2 are turned on. The induced AC voltage across the secondary winding of the power transformer T1 is rectified through the diode D1 and smoothed through the ground capacitor C1 so as to be converted into a first DC voltage of about 8 volts. The first DC voltage is supplied to an electronic appliance as an operational power supply voltage. Then the first DC voltage is dropped to a second DC voltage of 6.3 volts, which is the rated voltage of the cathode heater 2, through the resistor R1 which is used for controlling an input voltage. The second DC voltage is applied to the cathode heater 2 in order to energize the cathode heater 2 and thereby cause the cathode heater 2 to become warm.

The circuit shown in FIG. 1 energizes the cathode heater 2 by applying the rated voltage to the cathode heater 2 at the moment that the power switches SW1 and SW2 are turned on. One of the disadvantages of the circuit shown in FIG. 1 is the long wait needed prior to being able to view a stable image on the cathode ray tube. It requires approximately 10–11 seconds for the cathode ray tube 1 to display a stable image since it takes that amount of time for the cathode heater 2 to heat up to the normal operating temperature.

Figure 2:
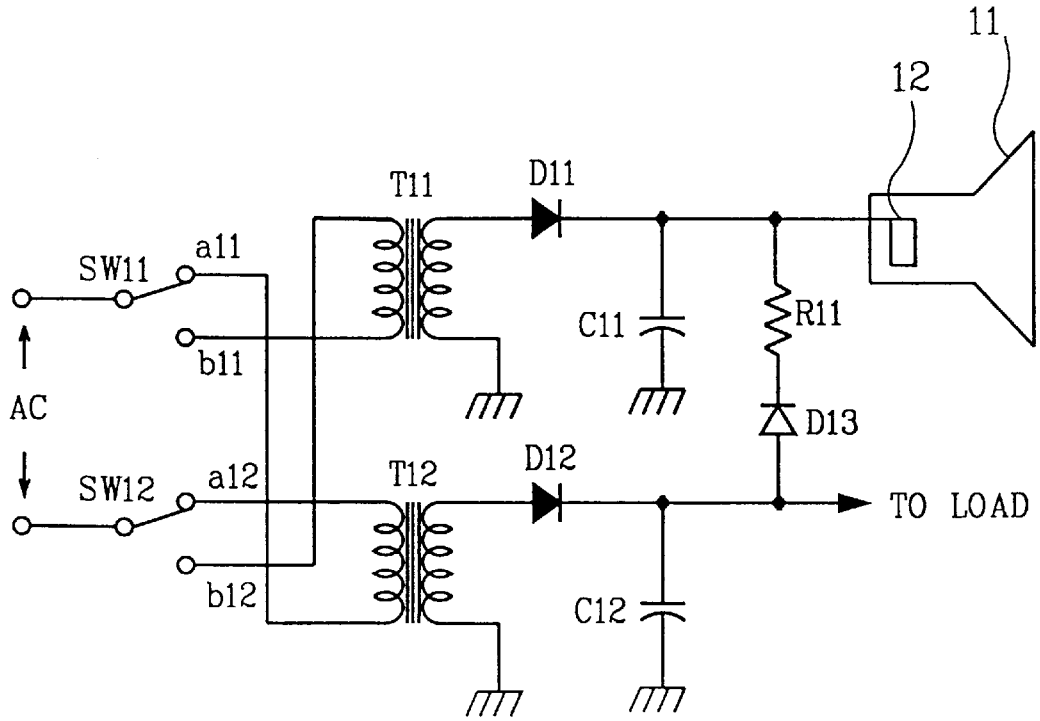
FIG. 2 illustrates another circuit for controlling a cathode heater of a cathode ray tube.

Turning now to FIG. 2, which illustrates another circuit for controlling a cathode heater of a cathode ray tube. The voltage AC is applied to activating terminals of power switches SW11 and SW12. The first fixed terminals a11 and a12 of the power switches SW11 and SW12 are connected to a primary winding of a power transformer T12. The second fixed terminals b11 and b12 of the power switches SW11 and SW12 are connected to a primary winding of a power transformer T11. A secondary winding of the power transformer T11 is connected to a ground capacitor C11 and a cathode heater 12 of a cathode ray tube 11 through a diode D11. A secondary winding of the power transformer T12 is connected to a ground capacitor C12 through a diode D12, and the juncture of the diode D12 and the ground capacitor C12 is connected to the cathode heater 12 of the cathode ray tube 11 through a diode D13 and a resistor R11.

In FIG. 2, the power switches SW11 and SW12 will be in the OFF position when the activating terminals of those power switches are connected to the second fixed terminals b11 and b12. When the power switches SW11 and SW12 arc in said OFF position, voltage AC is applied to the primary winding of the power transformer T11 through the power switches SW11 and SW12. The voltage AC applied to the primary winding of the power transformer T11 is induced to an AC voltage across the secondary winding of the power transformer T11. The induced AC voltage across the power transformer T11 is rectified through the diode D11 and smoothed through the ground capacitor C11 so as to be converted to a DC voltage of about 3–4 volts. The DC voltage of about 3–4 volts is applied to the cathode heater 12 of the cathode ray tube 11 to keep the cathode heater 12 energized and warm while the power switches SW11 and SW12 are in the OFF position.

In the circuit in FIG. 2, the power switches SW11 and SW12 will be in the ON position when the activating terminals of those power switches are connected to the first fixed terminals a11 and a12. When the power switches SW11 and SW12 are in said ON position, the voltage AC is applied to the primary winding of the power transformer T12 through those power switches, to thereby induce an AC voltage across the secondary winding of the power transformer T12. The voltage induced across the secondary winding of the power transformer T12 is rectified through the diode D12 and smoothed through the ground capacitor C12 to output a DC voltage of about 8 volts.

In FIG. 2, the DC voltage of about 8 volts is applied to a load as an operational power supply voltage and dropped to a voltage of about 6.3 volts through the diode D13 and the resistor R11. The voltage of about 6.3 volts is applied to the cathode heater 12 to cause it to be heated up to the normal operating temperature. A voltage which is lower than a rated voltage is applied to the cathode heater 12 to keep the cathode heater 12 energized and warm while the power switches SW11 and SW12 are in the OFF position, whereas the rated voltage is applied to the cathode heater 12 when the power switches SW11 and SW12 are in the ON position.

The circuit in FIG. 2 has several characteristics which might be considered to be disadvantages. For example, it utilizes a second transformer to keep the cathode heater energized, so that the cathode stays warm. Since transformers are expensive, the product cost is increased by the use of this second transformer. Also, a large amount of electrical energy is consumed when the cathode ray tube 11 is not being used, while the power switches SW11 and SW12 are in the OFF position. This could be considered wasteful. Or it could be considered a fire hazard. Also, it might be very difficult to meet the electrical power consumption limitations of DPMS. According to the DPMS, electrical power consumption must be less than 5 watts in the power-off state mode. Therefore, since electrical power consumption is about 3.6 watts while the cathode heater is being kept warm when said power switches are in the OFF position, an electronic appliance must be designed so that less than 1.4 watts is consumed in all other components. However, it is difficult to meet the limitation of electric power consumption proposed by the DPMS since electrical power over 1.4 watts is consumed in loads other than the cathode heater, for example in components such as the microprocessor.

Figure 3:
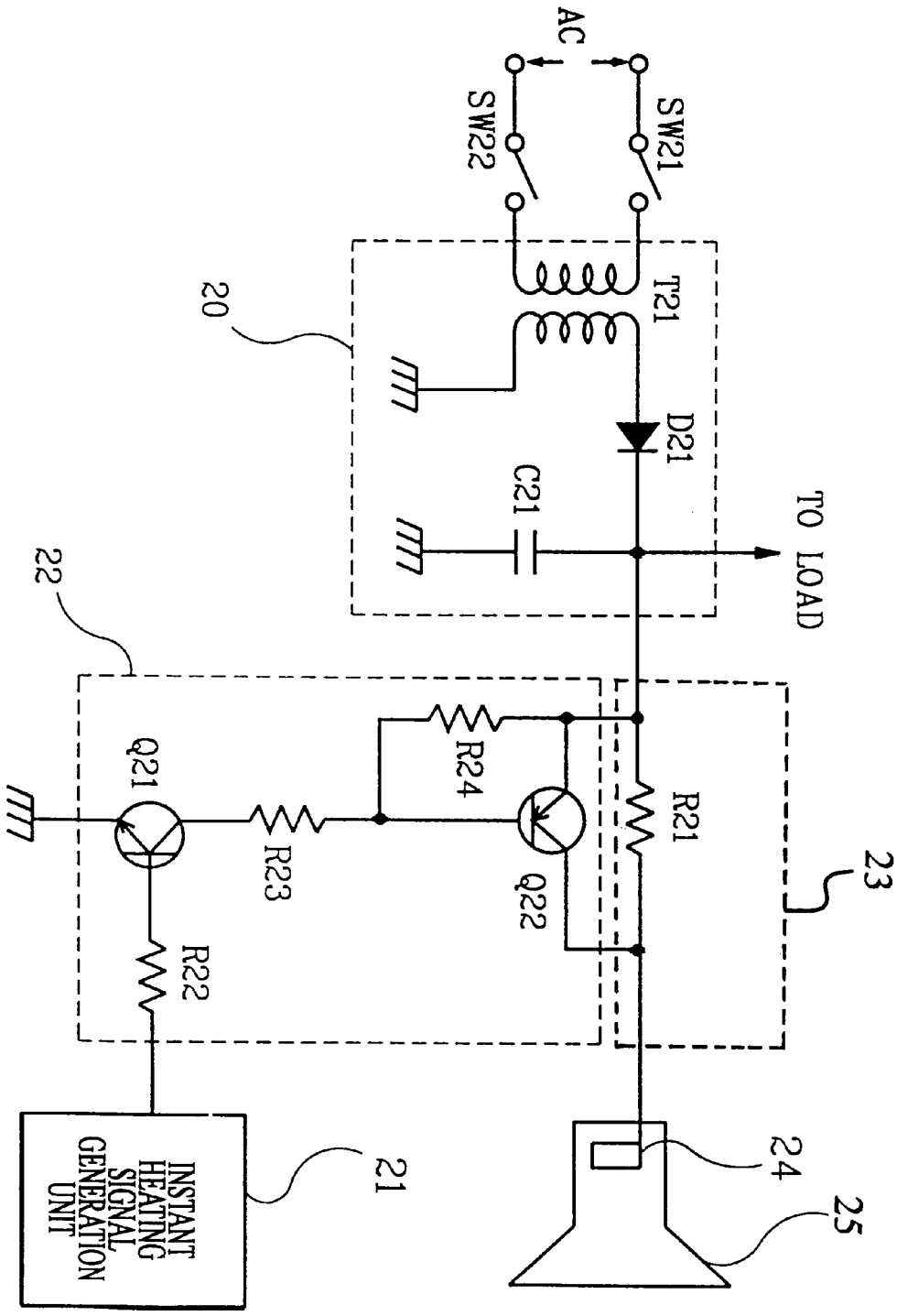
FIG. 3 illustrates a circuit for controlling a cathode heater of a cathode ray tube according to the principles of the present invention.

Turning now to FIG. 3, which illustrates a circuit for controlling a cathode heater of a cathode ray tube according to one preferred embodiment of the present invention. As shown in FIG. 3, there is a high voltage generation unit 20, an instant heating signal generation unit 21, an initial heating unit 22, a voltage drop unit 23, a cathode heater 24, and a cathode ray tube 25.

In FIG. 3, the high voltage generation unit 20 is used for generating an operational voltage higher than a rated voltage of a cathode heater 24 of a cathode ray tube 25 with an input of an AC power supply when power switches SW21 and SW22 are in the ON position. Power switches SW21 and SW22 are connected to a primary winding of a power transformer T21, and a secondary winding of the power transformer T21 is connected to a ground capacitor C21 through a diode D21. The operational voltage is output to a load from the connection point between the ground capacitor C21 and the diode D21. When the power switches SW21 and SW22 are turned to the ON position, the power supply voltage AC is applied to the primary winding of the power transformer T21 of the high voltage generation unit 20 through the power switches SW21 and SW22. The power supply voltage AC applied to the primary winding of the power transformer T21 causes an AC voltage to be induced across the secondary winding of the power transformer T21. The induced AC voltage is rectified through the diode D21 and smoothed through the ground capacitor C21, to thereby output a DC voltage of about 8 volts.

In the circuit in FIG. 3, the instant heating signal generation unit 21 is used for generating a driving pulse signal for a predetermined time period at the beginning of an application of voltage to the cathode heater 24. At the moment when the power switches SW21 and SW22 are turned to the ON position, that is, when beginning to energize the cathode heater 24, the instant heating signal generation unit 21 outputs a driving pulse signal of high voltage for a predetermined time period of, for example, about 3–4 seconds. The instant heating signal generation unit 21 may be a microcomputer, for example. In the case of the cathode ray tube 25 being used in a television set, the instant heating signal generation unit 21 generates the driving pulse signal when turning the power switches SW21 and SW22 to the ON position. In the case of the cathode ray tube 25 being used in a monitor, the instant heating signal generation unit 21 performs an electric power supply voltage management according to a horizontal synchronization signal and a vertical synchronization signal input from the main body of a computer system, turns on an application of a voltage to the monitor or cuts off an application of a voltage to the cathode heater 24 according to the horizontal and vertical synchronization signals input from the main body of the computer system, and controls the power switches SW21 and SW22 to be connected in case of converting to the power-on state mode with both the horizontal and vertical synchronization signals input as well as outputting a as driving pulse signal of high voltage for a predetermined time period. The driving pulse signal output from the instant heating signal unit 21 is applied to the initial heating unit 22.

In FIG. 3, the initial heating unit 22 is used for applying the operational voltage of the high voltage generation unit 20 to the cathode heater 24 during the driving pulse signal of the instant heating signal generation unit 21. In the initial heating unit 22, an output terminal of the instant heating signal generation unit 21 is connected to the base electrode of a first switching transistor Q21 through a resistor R22, and the collector electrode of the transistor Q21 is connected to the base electrode of the second switching transistor Q22 through a resistor R23. Further, an output terminal of the high voltage generation unit 20 is connected to the emitter electrode of the transistor Q22, the emitter electrode of the transistor Q22 is connected to the base electrode of the transistor Q22 and the resistor R23 through a resistor R24, and the collector electrode of the transistor Q22 is connected to the cathode heater 24 of the cathode ray tube 25.

In the circuit in FIG. 3, as previously stated, the driving pulse signal is output from the instant heating signal unit 21 and is applied to the initial heating unit 22. More specifically, the driving pulse signal is applied to the base electrode of the transistor Q21 through the resistor R22 of the initial heating unit 22 so that the transistor Q21 is turned on. When the transistor Q21 is turned on, a DC voltage which is output from the high voltage generation unit 20 is applied to the transistor Q21 through the resistors R23 and R24 and a low voltage is applied to the base electrode of the transistor Q22. At this time, with the transistor Q22 turned on, since the DC voltage output from the high voltage generation unit 20 is applied to the cathode heater 24 of the cathode ray tube 25 through the transistor Q22, the cathode heater 24 is energized and rapidly warmed by a high voltage of about 8 volts which is output by the high voltage generation unit 20. As a result, a cathode is rapidly heated by the cathode heater 24. It is preferable that a time period during which the instant heating signal generates the driving pulse signal of high voltage shall be set to be a time period required to heat the cathode up to a normal operating temperature due to the heating performed by the cathode heater 24 caused by the output voltage of the high voltage generation unit 20. Then, at the moment when the cathode is heated up to the normal operating temperature, and the predetermined time period has elapsed, the instant heating signal generation unit 21 shall output a low voltage. Said low voltage shall be applied to the base electrode of the transistor Q21. At this time, the transistor Q21 is turned off and the transistor Q22 is turned off. With the two transistors turned off, the high voltage output from the high voltage generation unit 20 is dropped to about 6.3 volts through the resistor R21, which is the rated voltage of the cathode heater 24. The rated voltage of about 6.3 volts is applied to the cathode heater 24 to keep the cathode at a normal operating temperature.

In FIG. 3, the voltage drop unit 23 having a resistor R21 is used for dropping the operational to voltage of the high voltage generation unit 20 to the rated voltage of the cathode heater 24 of the cathode ray tube 25 and for applying the rated voltage to the cathode heater 24.

As mentioned above, the present invention rapidly heats the cathode in a cathode ray tube by applying a high voltage, above the rated voltage of the cathode heater, to the cathode heater at the initiation of the operating mode. Subsequently, after a cathode is heated up to a normal operating temperature, the present invention drops the voltage down to the rated voltage of the cathode heater and applies that rated voltage to the cathode heater, so that a cathode ray tube can present a stable image within a short time period.

What is claimed is:

1. A circuit for controlling a cathode heater of a cathode ray tube, comprising:

a high voltage generation unit for generating a voltage higher than a rated voltage of said cathode heater;

a voltage drop unit for dropping the voltage of said high voltage generation unit to said rated voltage of said cathode heater, said voltage drop unit being coupled to said high voltage generation unit;

an instant heating signal generation unit for generating a driving pulse signal for a predetermined time period; and an initial heating unit for transmitting the voltage of said high voltage generation unit to said cathode heater during said predetermined time period in response to said driving pulse signal, and for enabling transmission of said rated voltage generated from said voltage drop unit to said cathode heater when said predetermined time period elapses, said circuit performing said controlling of said cathode heater without utilizing positive temperature coefficient units, said initial heating unit being coupled in parallel to said voltage drop unit.

2. The circuit of claim 1, wherein said predetermined time period of said driving pulse signal corresponds to a time period required in order for a cathode to be heated up to a normal operating temperature by said cathode heater due to the output voltage of said high voltage generation unit.

3. The circuit of claim 1, wherein said initial heating unit comprises:

a first switching unit, to be turned on during said predetermined time period of said driving pulse signal of the instant heating signal generation unit; and a second switching unit, to be turned on while said first switching unit is turned on, for enabling transmission of the voltage of said high voltage generation unit to said cathode heater.

4. The circuit of claim 3, wherein said first switching unit is a p-type transistor having a first electrode of a principally conducting channel connected to ground, a second electrode of said principally conducting channel connected to said second switching unit, and a control electrode connected to said instant heating signal generation unit to receive said driving pulse signal.

5. The circuit of claim 3, wherein said second switching unit is an n-type transistor having a first electrode of a principally conducting channel connected to an output terminal of said initial heating unit, a second electrode of said principally conducting channel connected to an input terminal of said initial heating unit, and a control electrode connected to said first switching unit.

6. The circuit of claim 1, wherein said high voltage generation unit comprises:

a power supply source;

a power transformer having a primary coil connected to said power supply, and a grounded secondary coil;

a diode connected to said grounded secondary coil of said power transformer;

a grounded capacitor connected to said diode; and an output terminal, connected to said grounded capacitor and said diode, for transmitting the high voltage which is higher than said rated voltage of said cathode heater.

7. The circuit of claim 1, wherein said initial heating unit comprises:

a first transistor of a p-type having a control electrode connected to said instant heating signal generation unit across a first resistor, a first electrode of a principally conducting channel connected to ground, and a second electrode of said principally conducting channel connected to a first junction across a second resistor;

a second transistor of an n-type having a control electrode connected to said first junction, a first electrode of a principally conducting channel connected to said first junction across a third resistor, and a second electrode of said principally conducting channel connected to said cathode heater;

an input terminal connected to said first electrode of said second transistor and connected to an output terminal of said high voltage generation unit; and an output terminal connected to said second electrode of said second transistor and connected to said voltage drop unit.

8. The circuit of claim 1, wherein said voltage drop unit comprises a resistor for dropping the voltage of said high voltage generation unit down to said rated voltage of said cathode heater.

9. A circuit for controlling a cathode heater of a cathode ray tube, comprising:

a high voltage generation unit for generating a voltage higher than a rated voltage of said cathode heater;

an instant heating signal generation unit for generating a driving pulse signal for a predetermined time period; and a heating unit for applying the voltage of said high voltage generation unit to said cathode heater during said predetermined time period of said driving pulse signal, and for applying the rated voltage of said cathode heater to said cathode heater when said predetermined time period of said driving pulse signal elapses, said circuit performing said controlling of said cathode heater without utilizing positive temperature coefficient units.

10. The circuit of claim 9, wherein said predetermined time period corresponds to a time period required in order for the cathode to be heated up to a normal operating temperature by said cathode heater due to the output voltage of said high voltage generation unit.

11. The circuit of claim 9, wherein said heating unit comprises:

a a first switching unit, to be turned on during said predetermined time period;

a second switching unit, to be turned on after said first switching unit is turned on, for applying the voltage of said high voltage generation unit to said cathode heater; and a voltage drop unit disposed between said high voltage generation unit and said cathode heater, for dropping the voltage of said high voltage generation unit down to the rated voltage of said cathode heater.

12. The circuit of claim 11 , wherein said first switching unit is a p-type transistor having a first electrode of a principally conducting channel connected to ground, a second electrode of said principally conducting channel connected to said second switching unit, and a control electrode connected to said instant heating signal generation unit to receive said driving pulse signal.

13. The circuit of claim 11, wherein said second switching unit is an n-type transistor having a first electrode of a principally conducting channel connected to an output terminal of said voltage drop unit, a second electrode of said principally conducting channel connected to an input terminal of said voltage drop unit, and a control electrode connected to said first switching unit.

14. The circuit of claim 11, wherein said voltage drop unit is a resistor connecting said high voltage generation unit to said cathode heater.

15. The circuit of claim 9, wherein said high voltage generation unit comprises:

a power supply source;

a power transformer having a primary coil connected to said power supply source, and a grounded secondary coil;

a diode connected to said secondary coil of said power transformer;

a grounded capacitor connected to said diode; and an output terminal connected to said grounded capacitor and said diode, for transmitting the high voltage which is higher than said rated voltage of said cathode heater.

16. The circuit of claim 9, wherein said heating unit comprises:

a first resistor disposed between said high voltage generation unit and said cathode heater;

a first transistor of a p-type having a control electrode connected to said instant heating signal generation unit across a second resistor, a first electrode of a principally conducting channel connected to ground, and a second electrode of said principally conducting channel connected to a first junction across a third resistor;

a second transistor of an n-type having a control electrode connected to said first junction, a first electrode of a principally conducting channel connected to said first resistor and said high voltage generation unit, and a second electrode of said principally conducting channel connected to said cathode heater; and a fourth resistor connecting said first junction to said first electrode of said second transistor.

17. A method for energizing a cathode heater of a cathode ray tube, comprising:

generating a driving pulse signal during a predetermined time period for initially energizing said cathode heater;

applying a voltage higher than a rated voltage of said cathode heater to said cathode heater for energizing said cathode heater during said predetermined time period of said driving pulse signal; and applying said rated voltage of said cathode heater to said cathode heater when said predetermined time period of said driving pulse signal elapses, said method for energizing said cathode heater not utilizing positive temperature coefficient units.

18. The method of claim 17, said cathode heater operating in an initial on mode when the voltage higher than said rated voltage is received by said cathode heater, said cathode heater operating in a standard on mode when said rated voltage is received by said cathode heater, said cathode heater not receiving power at all other times.

19. The method of claim 18, further comprising a heating unit being coupled to said cathode heater for performing said applying of said voltage higher than said rated voltage and for performing said applying of said rated voltage.

* * * * *